US006854296B1

(12) United States Patent
Miller, III

(10) Patent No.: US 6,854,296 B1
(45) Date of Patent: Feb. 15, 2005

(54) BI-PLY FABRIC CONSTRUCTION AND APPAREL FORMED THEREFROM

(75) Inventor: Robert A. Miller, III, New Ringgold, PA (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/764,349

(22) Filed: Jan. 23, 2004

(51) Int. Cl.[7] ..... D04B 11/04
(52) U.S. Cl. ..... 66/190; 66/196
(58) Field of Search ..... 66/202, 169 R, 66/170–171, 176–177, 190, 196; 442/304–305, 312–313, 316

(56) References Cited

U.S. PATENT DOCUMENTS

| | | | | |
|---|---|---|---|---|
| 709,734 | A | 9/1902 | Bellis | |
| 2,879,654 | A | 3/1959 | Evans | 66/176 |
| 3,806,959 | A | 4/1974 | Gross | 5/334 R |
| 3,859,824 | A | 1/1975 | Krylov et al. | 66/10 |
| 3,930,387 | A | 1/1976 | Imamura | 66/190 |
| 3,986,374 | A | 10/1976 | Fane | 66/190 |
| 3,986,530 | A | 10/1976 | Maekawa | 139/425 R |
| 4,158,292 | A | 6/1979 | Ehedy et al. | 66/190 |
| 4,199,633 | A | 4/1980 | Blore | 428/91 |
| 4,244,197 | A | 1/1981 | Althammer | 66/19 |
| 4,278,717 | A | 7/1981 | Aoyama | 428/36 |
| 4,335,589 | A | 6/1982 | Flasher | 66/202 |
| 4,583,547 | A | 4/1986 | Granek et al. | 128/639 |
| 4,628,709 | A | 12/1986 | Aeschbach et al. | 66/9 R |
| 4,639,545 | A | 1/1987 | Pithouse et al. | 174/36 |
| 4,672,825 | A | 6/1987 | Yasukawa et al. | 66/194 |
| 4,729,377 | A | 3/1988 | Granek et al. | 128/639 |
| 4,753,088 | A | 6/1988 | Harrison et al. | 66/202 |
| 4,771,614 | A | 9/1988 | Kemp | 66/198 |
| 4,787,219 | A | 11/1988 | Sato et al. | 66/190 |
| 4,815,299 | A | 3/1989 | Bryant | 66/202 |
| 4,839,482 | A | 6/1989 | Ackermann et al. | 200/148 B |
| 4,856,299 | A | 8/1989 | Bryant | 66/202 |
| 4,921,751 | A | 5/1990 | Wakahara et al. | 428/229 |
| 5,013,089 | A | 5/1991 | Abu-Isa et al. | 297/452 |
| 5,023,430 | A | 6/1991 | Brekkestran et al. | 219/486 |
| 5,105,067 | A | 4/1992 | Brekkestran et al. | 219/497 |
| 5,147,714 | A | 9/1992 | Ellison et al. | 428/254 |
| 5,151,319 | A | 9/1992 | Schoutteten | 428/257 |
| 5,157,379 | A | 10/1992 | Dennison | 340/540 |
| 5,229,181 | A | 7/1993 | Daiber et al. | 428/58 |
| 5,310,590 | A | 5/1994 | Tochacek et al. | 428/102 |
| 5,364,678 | A | 11/1994 | Lumb et al. | 428/96 |
| 5,373,713 | A | * 12/1994 | Miller | 66/196 |
| 5,382,466 | A | 1/1995 | Ingham | 428/219 |
| 5,395,684 | A | 3/1995 | Robinson et al. | 428/253 |
| 5,422,153 | A | 6/1995 | Miyamoto | 428/95 |
| 5,472,769 | A | 12/1995 | Goerz, Jr. et al. | 428/138 |
| 5,545,470 | A | 8/1996 | Schuster et al. | 428/229 |
| 5,636,533 | A | * 6/1997 | Hunneke et al. | 66/196 |
| 5,641,560 | A | 6/1997 | Schmidt et al. | 428/220 |
| 5,651,847 | A | 7/1997 | Loeffler | 156/71 |

(List continued on next page.)

FOREIGN PATENT DOCUMENTS

EP 546962 A1 12/1991

*Primary Examiner*—Danny Worrell
(74) *Attorney, Agent, or Firm*—Womble Carlyle Sandridge & Rice, PLLC

(57) ABSTRACT

A knitted fabric comprising two confronting webs, each web being formed by a series of continuous lengths of yarn extending generally parallel to one another and having loops arranged in walewise and coursewise rows. One web overlies the other and, the two webs being united at intervals by a tuck stitch of yarn of one web engaging the other web. The tuck stitches are spaced apart walewise by a plurality of courses to create channels between the stitches. The channels extend walewise of the webs. At least one yarn is inserted under tension between the two fronting webs and held in parallel relation to the parallel lengths of yarn. When relaxed, the yarn inserted under tension causes the confronting webs to be spaced apart within each of the channels.

55 Claims, 3 Drawing Sheets

U.S. PATENT DOCUMENTS 5,735,145 A * 4/1998 Pernick ..... 66/196
5,787,503 A 8/1998 Murphy, III ..... 2/90
5,962,349 A 10/1999 Mizukami et al. ..... 442/311
5,965,223 A 10/1999 Andrews et al. ..... 428/34.5
6,006,550 A 12/1999 Singh ..... 66/13
6,057,253 A 5/2000 Groshens ..... 442/313
6,089,051 A 7/2000 Gorywoda et al. ..... 66/170
6,089,052 A 7/2000 Riegger ..... 66/195
6,096,667 A 8/2000 Rhode ..... 442/313
6,105,401 A 8/2000 Chadeyron et al. ..... 66/195
6,119,491 A 9/2000 Pinelli ..... 66/177
6,145,348 A 11/2000 Hardegree et al. ..... 66/192
6,216,497 B1 4/2001 Miyata et al. ..... 66/202
6,281,150 B1 8/2001 Groshens ..... 442/314
6,289,702 B1 9/2001 Heirbaut et al. ..... 66/202
6,291,375 B1 9/2001 Allen et al. ..... 442/308
6,341,504 B1 1/2002 Istook ..... 66/172 E
6,367,290 B2 4/2002 Kolmes et al. ..... 66/172 R
6,381,482 B1 4/2002 Jayaraman et al. ..... 600/388
6,397,641 B1 6/2002 Roell ..... 66/170
6,407,016 B1 6/2002 Van Steenlandt et al. ... 442/313
6,430,969 B1 8/2002 Roell ..... 66/170
6,477,865 B1 11/2002 Matsumoto ..... 66/195
2001/0022096 A1 9/2001 Orima ..... 66/170
2002/0102895 A1 8/2002 Willard ..... 442/244
2002/0104355 A1 8/2002 Shirasaki et al. ..... 66/196
2002/0134116 A1 9/2002 Sandbach ..... 66/202
2002/0152776 A1 10/2002 Laurent ..... 66/196
2002/0184927 A1 12/2002 Moretti ..... 66/196
2003/0033838 A1 2/2003 Ikenaga et al. ..... 66/196

* cited by examiner

BI-PLY FABRIC CONSTRUCTION AND APPAREL FORMED THEREFROM

FIELD OF THE INVENTION

The present invention relates to the field of textile production, and more particularly, to a knitted bi-ply fabric construction with particular application to multi-purpose apparel.

BACKGROUND OF THE INVENTION

Double knit, or bi-ply, fabrics have been knitted together for over a century. One of the earliest of these fabric constructions (U.S. Pat. No. 709,734) comprises two knitted fabric webs that are united by stitches causing the yarn in one of the webs to engage the other web at specified intervals. The bi-ply fabric produced thereby was found to exhibit several desirable characteristics, including the ability to have one web, or face, formed from one type of yarn, and the other web formed of yarns of a distinctly different type. The earliest of these bi-ply constructions included a wool outer face and a cotton inner face, providing the combination of warmth and comfort.

Over the past one hundred years, various constructions of bi-ply fabrics have evolved, with particular emphasis on creating specific characteristics in each ply of the fabric that could not be achieved in either ply alone. In more recent years, bi-ply fabric constructions have been developed to take advantage of other features that can be accomplished with the known bi-ply constructions. For example, U.S. Pat. No. 5,373,713 to Miller discloses a bi-ply structure where one web is formed with thin and thick yarns grouped in adjacent courses, where the grouped courses are alternated to produce a ridged effect in the fabric. The thick yarns produce ridges and the intermediate thin yarns produce air entrapment channels in one web. These air entrapment channels provide a double layer of insulating air, one layer at the inside surface of the fabric and the second layer within the interior of the fabric.

There is also known a method of alternating interlock stitches in a bi-ply construction to produce a series of individual air pockets arranged in a checkerboard pattern on the inner layer of the fabric. This construction, however, does not permit air movement or channeling between the overlying webs.

What is needed is a bi-ply construction wherein both webs of the fabric may be formed of similarly sized yarns and similar yarn materials, while providing air channels for movement between the two plies of the fabric construction.

There are also known in the art specialty garments having functional aspects intended to address particular known problems. For example, there is known a garment having an electronic heating control system incorporate therein. There are also known specialty garments that incorporate physiological monitoring or medicinal stimulation to a wearer. Each of these very specific garment constructions addresses one particular known problem; however, they provide little or no other known utility. What is also needed, therefore, is a multi-purpose, multi-functional fabric and apparel.

SUMMARY OF THE INVENTION

The present invention is directed to a knitted bi-ply fabric, a method of forming a knitted bi-ply fabric, and multi-functional apparel formed therefrom the knitted fabric.

The knitted fabric is formed on a conventional circular knitting machine as two overlying, confronting webs. Knitted on this type of machine, each web is formed as a series of continuous lengths of yarn extending generally parallel to one another and having loops arranged in both the walewise and coursewise directions. The overlying webs are united at spaced intervals by a tuck stitch of yarn of one web engaging the other web. The tuck stitches are spaced apart walewise by a plurality of courses and coursewise by a plurality of wales to create channels running walewise between the stitches.

At least one channel-opening yarn is inserted between the two overlying webs during the knitting operation. This yarn, or yarns, may be cotton, polyester, nylon, or rayon between 36/1 and 14/1. The channel-opening yarn is held substantially in parallel relation to the parallel lengths of yarn forming each of the two overlying webs. Specifically, the channel-opening yarn is inserted under tension during the knitting operation. At the completion of the knitting operation, when the fabric and channel-opening yarn is permitted to relax, the channel-opening yarn causes the confronting webs to be spaced apart within each of the channels between the tuck stitches.

The number of channel-opening yarns that are inserted is dependent upon the spacing, in courses, between the tuck stitches; however, the use of the tuck stitches in combination with the channel-opening yarns permits both of the overlying webs not only to be formed of the same yarn materials and sizes, but also eliminates the need for introducing large and small yarns in the fabric construction to enable opening of the channels. For example, in one embodiment, each of the two confronting webs may be formed of cotton yarns between 28/1 and 12/1. Alternatively, the two webs can be formed of different materials having different properties. For example, for winter-weight apparel, the outer web may be formed substantially of hydrophobic yarns for water resistance and the inner web may be formed of hydrophilic yarns to move moisture away from the wearer.

Another aspect of the present invention is directed to apparel formed from the knitted fabric described above. While not limited thereto, the bi-ply fabric may be formed into upper and lower garments such as tops and bottoms.

Yet another aspect of the present invention is directed to apparel in which the channel-opening yarns are also wire; i.e., the yarns are metallic and are desirably conductive. Apparel formed from such a fabric construction may enable the introduction of supplemental heating, electronic signal transmission and reception, and/or micro-computerization.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Figure 1:
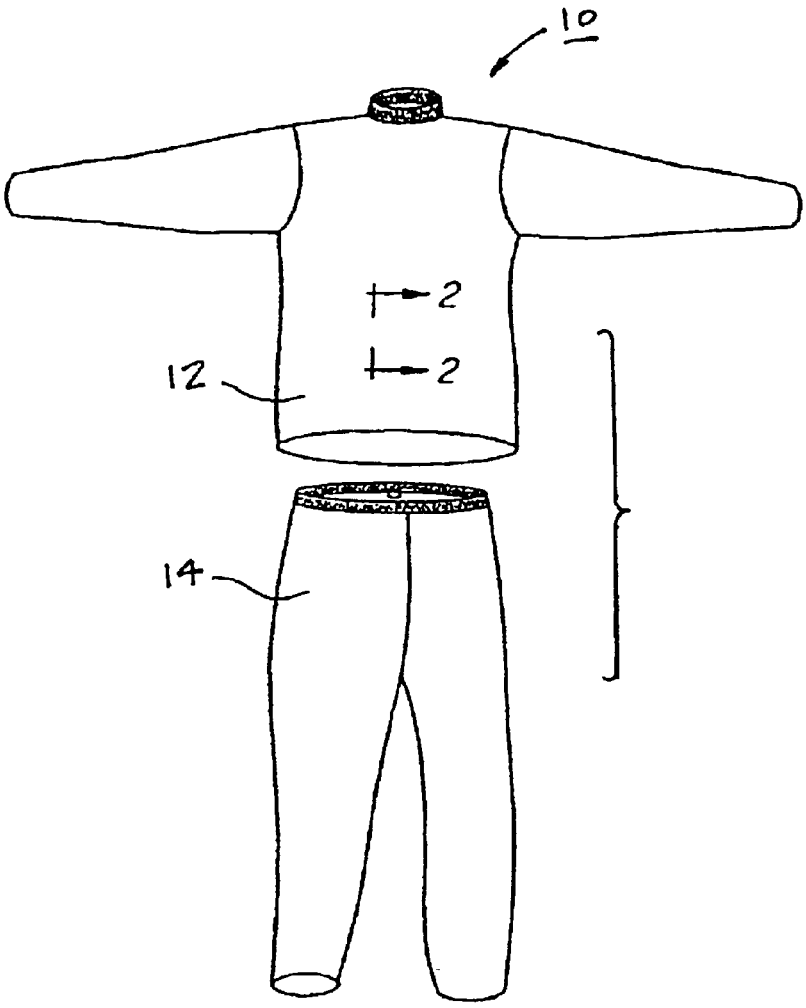
FIG. 1 is a view of a garment incorporating the bi-ply fabric of the present invention.

Referring first to FIG. 1, a garment is shown comprising a top 12 and a bottom 14, both made from a bi-ply fabric constituted by inner and outer knitted webs tucked together at intervals to form a composite fabric.

The fabric is produced on a rotating dial and cylinder (bi-ply/jersey type) circular knitting machine, modified so that each feed is knitted either by the dial or cylinder. For example, for the #1 feed, the high butt cylinder needles are welting, the low butt cylinder needles are tucking, and the dial needles are knitting. A suitable machine is a 14-gauge machine having twenty feeds, although the fabric may also suitably be formed on machines of other gauges. In the present instance, the 14-gauge machine comprises a dial having 612 needles and a cylinder having 612 needles. The cylinder needles produce the outer ply 22 of the fabric and the dial needles form the inner ply 26 of the composite fabric tube (see FIGS. 2 and 3).

Figure 2:
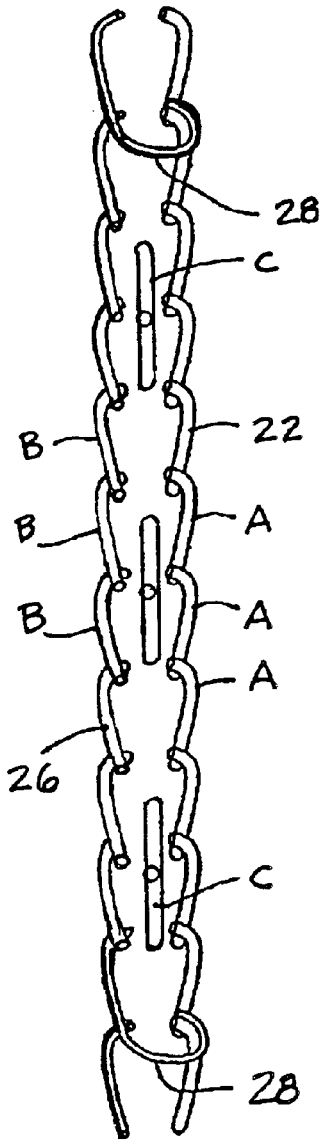
FIG. 2 is a sectional view of the bi-ply fabric of the present invention taken along Line 2—2 of FIG. 1 when the fabric is in a relaxed condition in the course direction.
Figure 3:
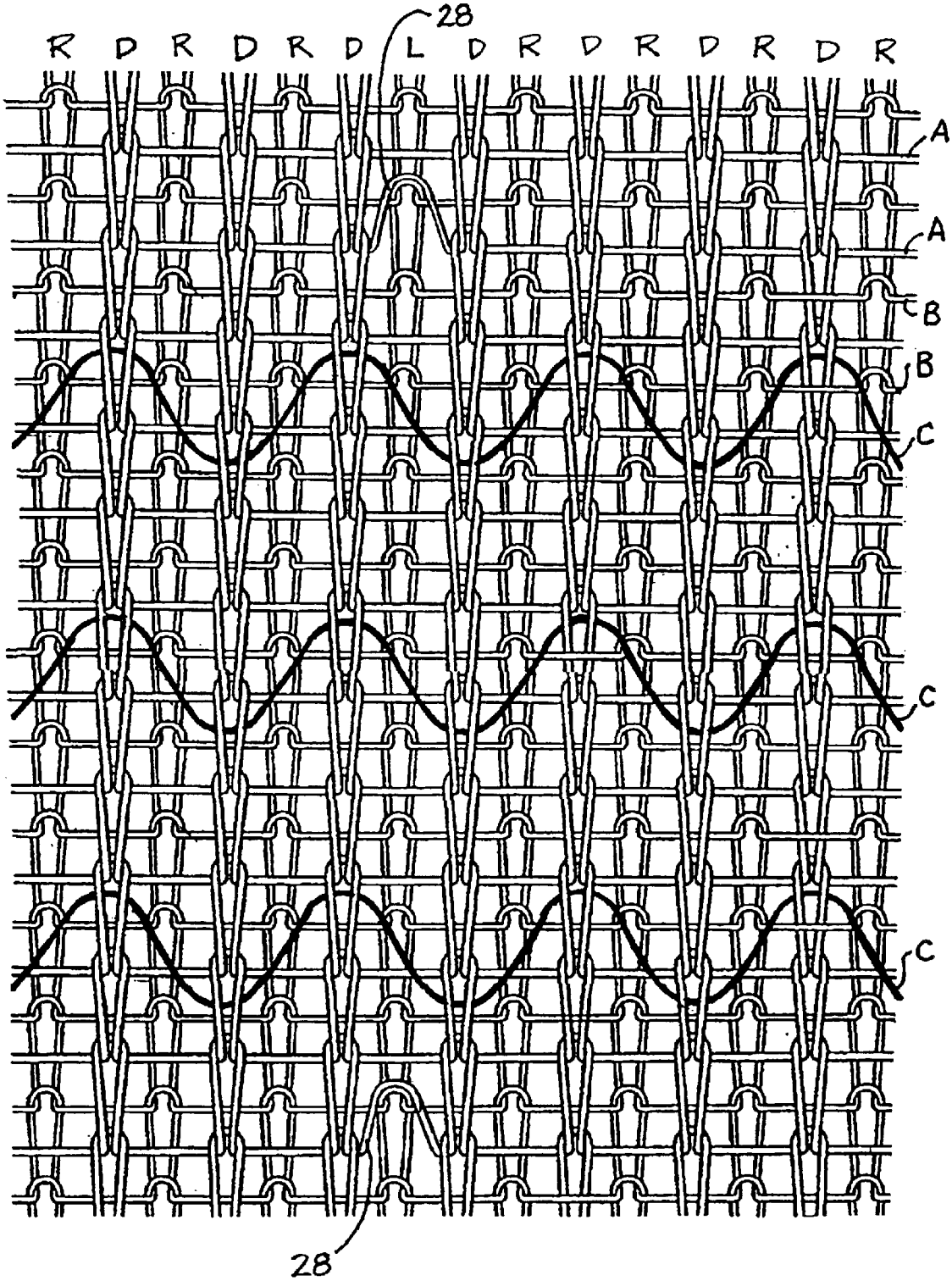
FIG. 3 is an enlarged diagrammatic view of the bi-ply fabric, illustrating in greater detail how the air pockets or channels are formed by the fabric construction of the present invention.

As shown in FIGS. 2 and 3, the inner ply 26 and the outer ply 22 are interconnected at intervals by a tuck stitch 28. On the knitting machine, the outer ply 22 is formed simultaneously with the inner ply 26 to form a continuous tube of two plies of fabric which, during fabrication are positioned so that the cylinder-knitted web is on the outside and the dial-knitted web is on the inside. During the knitting of the fabric, as the cylinder rotates past the feeders, the stitch cams elevate the tuck needle every ten courses to engage behind a dial needle and form a tuck stitch to tie the two plies of the fabric together.

In accordance with the present invention, the knitting machine is set up to feed yarns of similar size to the different yarn feeders of the circular knitting machine. Table I (below) is a chart of the knitting pattern for the fabric illustrated in FIGS. 2 and 3. The columns represent the positions of the regular-butt cylinder needles R, the low-butt cylinder needles L, and the dial needles D, respectively, as the cylinder is rotated past each feed. The knit pattern repeats on 20 feeds, as shown. Each row in the chart represents a feed. The character of the yarn at each feed is represented for convenience by the reference A or B, although in the embodiment shown in FIGS. 2 and 3, A and B are similar yarns. As will be discussed below, the A and B yarns may be of different sizes and types, depending upon the features desired in the final composite fabric.

The dial needles knit yarn from the odd numbered feeds, alternately. The cylinder needles, on the other hand, knit with the yarns at the even numbered feeds throughout the 20-course repeat. The stitches produced by this pattern are diagrammatically illustrated in FIG. 3. Each yarn (A, B) extends generally parallel to the other yarns, producing a single coursewise row of loops within the repeat. The regular butt needles form wales R in the fabric, the low butt cylinder needles form wales L, and the dial needles form wales D. In setting up the machine, in each set of 12 cylinder needles, there may be a single low butt needle, and the remainder will be regular butt needles so that the tuck stitches are knitted in every twelfth cylinder wale.

TABLE I

| Feed Number | Regular Butt Cylinder Needles | Low Butt Cylinder Needles | Dial Needles | Yarn Type |
|---|---|---|---|---|
| 1 | Welt | Tuck | Knit | A |
| 2 | Knit | Knit | Welt | B |
| 3 | Welt | Welt | Knit | A |
| 4 | Knit | Knit | Welt | B |
| 5 | Welt | Welt | Knit | A |
| 6 | Knit | Knit | Welt | B |
| 7 | Welt | Welt | Knit | A |
| 8 | Knit | Knit | Welt | B |
| 9 | Welt | Welt | Knit | A |
| 10 | Knit | Knit | Welt | B |
| 11 | Welt | Welt | Knit | A |
| 12 | Knit | Knit | Welt | B |
| 13 | Welt | Welt | Knit | A |
| 14 | Knit | Knit | Welt | B |
| 15 | Welt | Welt | Knit | A |
| 16 | Knit | Knit | Welt | B |
| 17 | Welt | Welt | Knit | A |
| 18 | Knit | Knit | Welt | B |
| 19 | Welt | Welt | Knit | A |
| 20 | Knit | Knit | Welt | B |
| 21 | Welt | Tuck | Knit | A |
| 22 | Knit | Knit | Welt | B |
| 23 | Welt | Welt | Knit | A |
| 24 | Knit | Knit | Welt | B |
| 25 | Welt | Welt | Knit | A |
| 26 | Knit | Knit | Welt | B |
| 27 | Welt | Welt | Knit | A |
| 28 | Knit | Knit | Welt | B |
| 29 | Welt | Welt | Knit | A |
| 30 | Knit | Knit | Welt | B |
| 31 | Welt | Welt | Knit | A |
| 32 | Knit | Knit | Welt | B |
| 33 | Welt | Welt | Knit | A |
| 34 | Knit | Knit | Welt | B |
| 35 | Welt | Welt | Knit | A |
| 36 | Knit | Knit | Welt | B |
| 37 | Welt | Welt | Knit | A |
| 38 | Knit | Knit | Welt | B |
| 39 | Welt | Welt | Knit | A |
| 40 | Knit | Knit | Welt | B |

In one embodiment, the outer ply 22 is desirably formed of cotton yarns between 26/1 and 12/1, although the invention is not limited thereto. The outer ply 22 may alternatively have an even feed of a different type of yarn or yarn size, although when similarly sized yarns are used, the outer ply 22 provides a smooth and neat appearance. Other natural or synthetic-fiber yarns may be substituted to produce any special features that may be desired in the outer ply 22. The inner ply 26 also comprises cotton yarns between 26/1 and 12/1. The interconnected plies 22, 26 ultimately provide an air entrapment barrier to the inside channel formed between the inner and outer plies.

In a second embodiment, the inner ply 26 is formed of hydrophilic yarns, such as cotton, to promote the movement of moisture away from a wearer of a garment formed from the composite fabric. The outer ply 22 is then formed of hydrophobic yarns, such as polyester or nylon, to provide a water-repellent exterior. As those skilled in the art will appreciate, there are numerous possible combinations of yarn types and sizes.

At least one channel-opening yarn C is inserted between the two overlying webs during the knitting operation. In one embodiment, the yarn, or yarns, may be cotton, polyester, nylon, or rayon between 36/1 and 14/1. The channel-opening yarn C is held substantially in parallel relation to the parallel lengths of yarn forming each of the two overlying webs. Specifically, the channel-opening yarn C is inserted under tension during the knitting operation. At the completion of the knitting operation, when the fabric and channel-opening yarn is permitted to relax, the channel-opening yarn C causes the confronting webs to be spaced apart within each of the channels between the tuck stitches. As shown in FIGS. 2 and 3, when the fabric is permitted to relax, the channel-opening yarns C retract into a sinusoidally-shaped orientation in the coursewise direction. Each yarn C is fed through the stop motion of the storage feeder (not around the feedwheel). The yarn is then pulled in between the two layers of fabric in front of a dial knit feed. The tension of each feed is between about 4 grams and 6 grams. This permits a yarn draw of between 94 inches per revolution and 106 inches per revolution of the cylinder; however, as those skilled in the art will appreciate, draw is directly related to the weight per square yard of the fabric.

The number of channel-opening yarns that are inserted is dependent upon the spacing, in courses, between the tuck stitches; however, the number and spacing of the channel-opening yarns is not critical to the present invention. The use of the tuck stitches in combination with the channel-opening yarns permits both of the overlying webs to be formed of the same yarn materials and sizes, and also eliminates the need for introducing large and small yarns in the fabric construction so as to create channel openings otherwise.

With the machine setup for forming the bi-ply fabric construction, certain settings are made for laying-in/inserting the one to three strands of channel-opening yarns between the tucks in the bi-ply fabric. The cap of the knitting machine is raised to a setting of 0.110 inches to make space for the laid-in yarns. The storage feeders for the channel-opening yarns are mounted between the cylinder tucks for stop motion only.

Another aspect of the present invention is directed to the bi-ply fabric as described above wherein the channel-opening yarns C are formed of a wire material that is desirably conductive. In one embodiment, the wire yarns are selected from the group of metallic yarns consisting of stainless steel, copper, nichromium and silver; however, the yarns are not limited thereto so long as they provide suitable electrical conductivity, resistance, radio frequency transmission, etc. as required for the intended applications described hereinbelow. Further, the metallic yarns may have outer covers such as silicon encapsulated wire for ultimate connection to a silicon microcomputer chip. Depending upon the particular application, the wire yarns are between about 27 American Wire Gauge (AWG) and 33 AWG. The wire yarns may further be braided or tinned and may be coated or uncoated. Suitable coatings/covers include cotton fabric outer sheathing, polyvinyl chloride (PVC) coating, or silicone encapsulation.

Figure 4A:
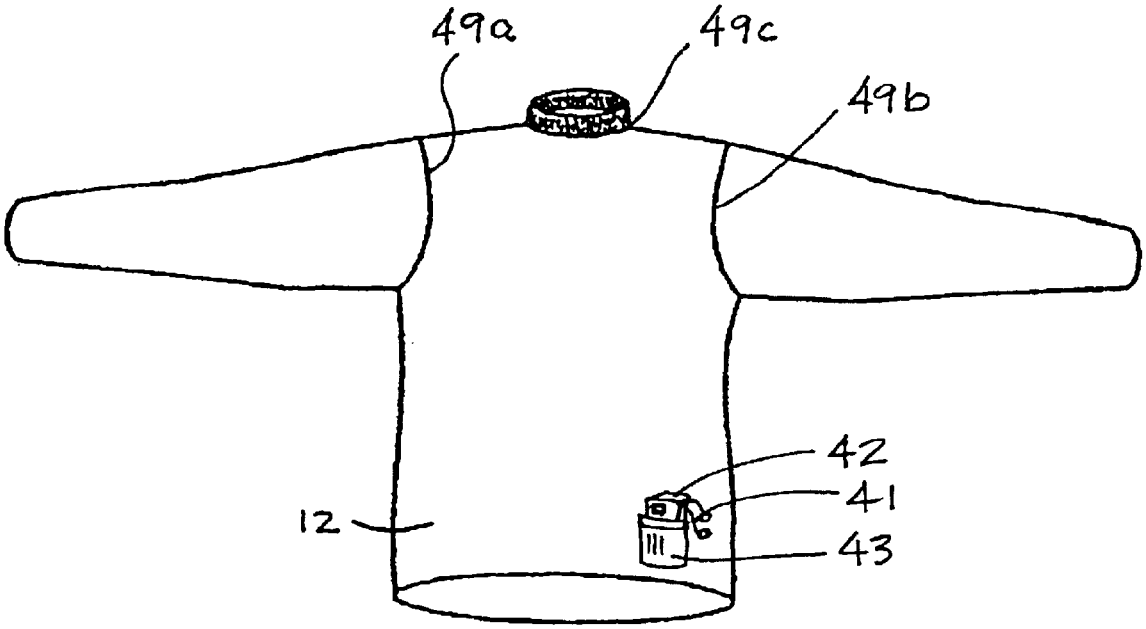
FIGS. 4A and 4B are views of a garment incorporating the bi-ply fabric of the present invention having conductive yarns incorporated therein and an electronic device connected thereto.
Figure 4B:
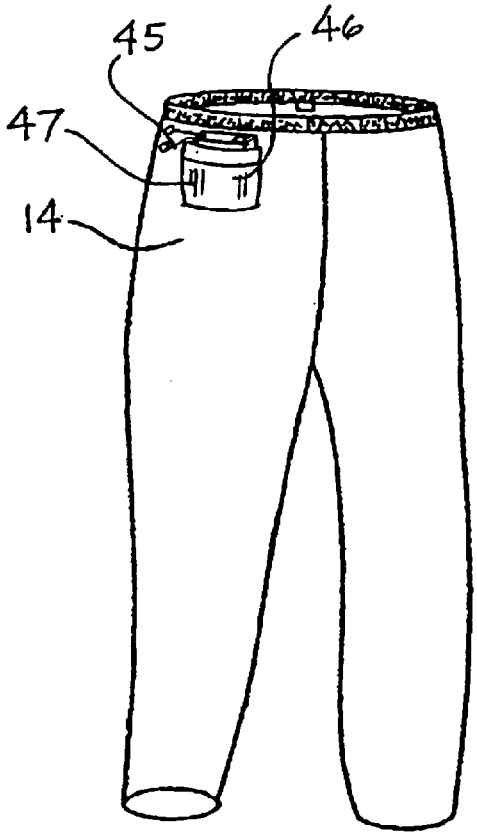

In one embodiment, the channel-opening yarns C of wire yarns provide two functions. First, they provide the channel-opening described above, and secondly, they provide a resistance heating structure between the outer 22 and inner 26 plies of the fabric construction of the present invention. The channel-opening/conductive yarns C are inserted into the fabric structure in the same manner described above. It has been found that a battery-powered or solar-powered resistance temperature device 42, 46 (shown in FIGS. 4A and 4B) may be interconnected to the terminal ends of the channel-opening/conductive yarns to complete the resistance heating circuit. Such a device is typical of suitable compact resistance temperature devices that may easily be inserted into a pocket or pouch 43, 47 and interconnected via a connector 41, 45 to the conductive yarns. If desired, a thermostatic controller, or rheostat (not shown) may be installed in the circuit to provide a wearer with the ability to regulate the amount of heat generated by the device 42, 46. Where multiple channel-opening/conductive yarns are incorporated into the fabric, and/or where a garment comprises multiple tubular pieces of fabric that are seamed together, the free ends of the channel-opening/conductive yarns may be joined by conductive flat seam stitches, tacks, conductive patches, or the like, at the seams 49*a*, 49*b*, 49*c*.

In a second embodiment, one or more of the channel-opening/conductive yarns C serve as an antenna for the receipt and transmission of radio frequency (RF) signals. An antenna of this type and structure is capable of receiving and transmitting radio frequency signals for portable devices 42,46 such as cell telephones, wireless digital devices, etc. that are capable of transmitting voice and data signals.

In yet another embodiment, the conductive yarns C are connectable to a micro-computer device such as a global positioning system (GPS), personal digital assistant (PDA), etc.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A knitted fabric, comprising:

(a) two confronting webs, each web being formed by a series of continuous lengths of yarn extending generally parallel to one another and having loops arranged in walewise and coursewise rows;

(b) one web overlying the other and united at intervals by a stitch of yarn of one web engaging the other web, the stitches being spaced apart walewise by a plurality of courses to create channels therebetween the stitches, the channels extending walewise of the webs; and (c) at least one yarn inserted therein under tension between the two fronting webs and held in parallel relation to the parallel lengths of yarn, wherein when relaxed the at least one yarn inserted under tension causes the confronting webs to be spaced apart within each of the channels.

2. The knitted fabric of claim 1 wherein the two confronting webs are similarly formed.

3. The knitted fabric of claim 2 wherein each of the two confronting webs is formed of cotton yarns between 12/1 and 36/1.

4. The knitted fabric of claim 1 wherein the two confronting webs are each formed of cotton yarns of different sizes.

5. The knitted fabric of claim 4 wherein the two confronting webs are formed of cotton yarns between 12/1 and 36/1.

6. The knitted fabric of claim 1 wherein one web is formed substantially of hydrophobic yarns and the other web is formed substantially of hydrophilic yarns.

7. The knitted fabric of claim 1 wherein the at least one yarn inserted under tension is selected from the group consisting of cotton, polyester, nylon, rayon, stainless steel, copper, nichromium, and silver.

8. The knitted fabric of claim 1 wherein the at least one yarn inserted under tension is between 12/1 and 36/1.

9. The knitted fabric of claim 1 wherein the at least one yarn inserted under tension is inserted at a tension of between about 4 grams and 6 grams.

10. An article of apparel formed from a knitted fabric, the knitted fabric comprising:

(a) two confronting webs, each web being formed by a series of continuous lengths of yarn extending generally parallel to one another and having loops arranged in walewise and coursewise rows;

(b) one web overlying the other and united at intervals by a stitch of yarn of one web engaging the other web, the stitches being spaced apart walewise by a plurality of courses to create channels therebetween the stitches, the channels extending walewise of the webs; and (c) at least one yarn inserted therein under tension between the two fronting webs and held in parallel relation to the parallel lengths of yarn, wherein when relaxed the at least one yarn inserted under tension causes the confronting webs to be spaced apart within each of the channels.

11. The article of apparel of claim 10 wherein the two confronting webs are similarly formed.

12. The article of apparel of claim 1 wherein each of the two confronting webs are formed of cotton yarns between 12/1 and 36/1.

13. The article of apparel of claim 10 wherein the two confronting webs are each formed of cotton yarns of different sizes.

14. The article of apparel of claim 13 wherein the two confronting webs are formed of cotton yarns between 12/1 and 36/1.

15. The article of apparel of claim 10 wherein one web is formed substantially of hydrophobic yarns and the other web is formed substantially of hydrophilic yarns.

16. The article of apparel of claim 10 wherein the at least one yarn inserted under tension is selected from the group consisting of cotton, polyester, nylon, rayon, stainless steel, copper, nichromium, and silver.

17. The article of apparel of claim 10 wherein the at least one yarn inserted under tension is between 12/1 and 36/1.

18. The article of apparel of claim 10 wherein the at least one yarn inserted under tension is inserted at a tension of between about 4 grams and 6 grams.

19. A method for forming a bi-ply knitted fabric, comprising:

(a) knitting two confronting webs, each web being formed by a series of continuous lengths of yarn extending generally parallel to one another and having loops arranged in walewise and coursewise rows;

(b) uniting the two confronting webs at spaced intervals by stitching a yarn of one web to engage the other web, the stitches being spaced apart walewise by a plurality of courses to create channels therebetween the stitches, the channels extending walewise of the webs; and (c) inserting at least one yarn under tension therebetween the two confronting webs so that the at least one yarn is held in parallel relation to the parallel lengths of yarn, wherein when relaxed the at least one yarn inserted under tension causes the confronting webs to be spaced apart within each of the channels.

20. The method of claim 19 wherein the two confronting webs are similarly formed.

21. The method of claim 20 wherein each of the two confronting webs are formed of cotton yarns between 12/1 and 36/1.

22. The method of claim 19 wherein the two confronting webs are each formed of cotton yarns of different sizes.

23. The method of claim 22 wherein the two confronting webs are formed of cotton yarns between 12/1 and 36/1.

24. The method of claim 19 wherein one web is formed substantially of hydrophobic yarns and the other web is formed substantially of hydrophilic yarns.

25. The method of claim 19 wherein the at least one yarn inserted under tension is selected from the group consisting of cotton, polyester, nylon, rayon, stainless steel, copper, nichromium, and silver.

26. The method of claim 19 wherein the at least one yarn inserted under tension is between 12/1 and 36/1.

27. The method of claim 19 wherein the at least one yarn inserted under tension is inserted at a tension of between about 4 grams and 6 grams.

28. A knitted fabric, comprising:

(a) two confronting webs, each web being formed by a series of continuous lengths of yarn extending generally parallel to one another and having loops arranged in walewise and coursewise rows;

(b) one web overlying the other and united at intervals by a tuck stitch of yarn of one web engaging the other web, the stitches being spaced apart walewise by a plurality of courses to create channels therebetween the tuck stitches, the channels extending walewise of the webs; and (c) at least one yarn of wire inserted therein between the two fronting webs and held generally parallel to the coursewise rows by said tuck stitches.

29. The knitted fabric of claim 28 wherein the two confronting webs are similarly formed.

30. The knitted fabric of claim 29 wherein each of the two confronting webs are formed of cotton yarns between 12/1 and 36/1.

31. The knitted fabric of claim 28 wherein the two confronting webs are each formed of cotton yarns of different sizes.

32. The knitted fabric of claim 31 wherein the two confronting webs are formed of cotton yarns between 12/1 and 36/1.

33. The knitted fabric of claim 28 wherein one web is formed substantially of hydrophobic yarns and the other web is formed substantially of hydrophilic yarns.

34. The knitted fabric of claim 28 wherein the at least one yarn of wire is inserted under tension.

35. The knitted fabric of claim 34 wherein the at least one yarn of wire inserted under tension is selected from the group consisting of stainless steel, copper, nichromium, silver, and combinations thereof.

36. The knitted fabric of claim 34 wherein the at least one yarn of wire inserted under tension is between 27 AWG and 33 AWG.

37. The knitted fabric of claim 34 wherein the at least one yarn inserted under tension is inserted at a tension of between about 4 grams and 6 grams.

38. An article of apparel formed from a knitted fabric, the knitted fabric comprising:

(a) two confronting webs, each web being formed by a series of continuous lengths of yarn extending generally parallel to one another and having loops arranged in walewise and coursewise rows;

(b) one web overlying the other and united at intervals by a tuck stitch of yarn of one web engaging the other web, the tuck stitches being spaced apart walewise by a plurality of courses to create channels therebetween the stitches, the channels extending walewise of the webs; and (c) at least one yarn of wire inserted therein between the two fronting webs and held generally parallel to the coursewise rows by said tuck stitches.

39. The article of apparel of claim 38 wherein the two confronting webs are similarly formed.

40. The article of apparel of claim 39 wherein each of the two confronting webs are formed of cotton yarns between 12/1 and 36/1.

41. The article of apparel of claim 38 wherein the two confronting webs are each formed of cotton yarns of different sizes.

42. The article of apparel of claim 41 wherein the two confronting webs are formed of cotton yarns between 12/1 and 36/1.

43. The article of apparel of claim 38 wherein one web is formed substantially of hydrophobic yarns and the other web is formed substantially of hydrophilic yarns.

44. The article of apparel of claim 38 wherein the at least one yarn of wire is inserted under tension.

45. The article of apparel of claim 44 wherein the at least one yarn inserted under tension is selected from the group consisting of stainless steel, copper, nichromium, silver, and combinations thereof.

46. The article of apparel of claim 44 wherein the at least one yarn of wire inserted under tension is between 27 AWG and 33 AWG.

47. The article of apparel of claim 44 wherein the at least one yarn of wire inserted under tension is inserted at a tension of between about 4 grams and 6 grams.

48. The article of apparel of claim 38 further including a transmitter connectable to the at least one yarn of conductive material.

49. The article of apparel of claim 48 further including a power source for providing electric power to the transmitter.

50. The article of apparel of claim 38 further including a receiver connectable to the at least one yarn of conductive material.

51. The article of apparel of claim 50 further including a power source for providing electric power to the receiver.

52. The article of apparel of claim 38 further including a resistance heating device connectable to the at least one yarn of conductive material.

53. The article of apparel of claim 52 further including a power source for providing electric power to the resistance heating device.

54. The article of apparel of claim 38 further including a microcomputer device connectable to the at least one yarn of conductive material.

55. The article of apparel of claim 54 further including a power source for providing electric power to the microcomputer device.

* * * * *